US006249975B1

(12) United States Patent
Lin

(10) Patent No.: US 6,249,975 B1
(45) Date of Patent: Jun. 26, 2001

(54) BLADE SUPPORT DEVICE FOR A KNIFE

(76) Inventor: Hsing Tai Lin, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/467,226

(22) Filed: Dec. 20, 1999

(51) Int. Cl.[7] ..... B26B 1/08
(52) U.S. Cl. ..... 30/162; 30/335
(58) Field of Search ..... 30/151, 162, 329, 30/335

(56) References Cited

U.S. PATENT DOCUMENTS 3,577,637 * 5/1971 Braginetz ..... 30/162
4,242,795 * 1/1981 Rollband et al. ..... 30/162
5,644,843 * 7/1997 Young ..... 30/162
5,813,121 * 9/1998 Gringer ..... 30/162
5,870,828 * 2/1999 Polites ..... 30/162
5,890,290 * 4/1999 Davis ..... 30/162

* cited by examiner

*Primary Examiner*—Hwei-Siu Payer

(57) ABSTRACT

A knife includes a blade support device slidably received in a housing for supporting a blade and having a spring limb. The spring limb includes one or more catches engaged with the blade for securing the blade to the blade support device. A button is slidably received in the housing and has one or more spring legs for disengaging the catches from the blade and for allowing the blade to be engaged into and disengaged from the blade support device without removing the blade support device from the housing. A knob may move the blade support device along the housing.

8 Claims, 4 Drawing Sheets

BLADE SUPPORT DEVICE FOR A KNIFE

BACKGROUND OF THE INVENTION

1. Field of the Invention

The present invention relates to a knife, and more particularly to a knife having a blade support device.

2. Description of the Prior Art

Typical knives comprise a blade slidably received in a housing or a handle. The blades may not be disengaged from the housing and may not be easily replaced or changed with the other blades when the old blade has been worn out. The housing has to be disassembled or the members of the housing should be separated from each other before the blades may be engaged into or disengaged from the housing.

The present invention has arisen to mitigate and/or obviate the afore-described disadvantages of the conventional knives.

SUMMARY OF THE INVENTION

The primary objective of the present invention is to provide a knife having a blade support device for allowing the blades to be easily and quickly changed without disassembling the housing.

In accordance with one aspect of the invention, there is provided a knife comprising a housing including a channel formed therein, a blade support device slidably received in the channel of the housing. the blade support device including at least one spring-biased catch extended therefrom, a blade including at least one notch formed therein for receiving the spring-biased catch and for securing the blade to the blade support device, and means for disengaging the spring-biased catch from the blade to disengage the blade from the blade support device and to secure the blade to the blade support device.

The blade support device includes a spring limb formed therein and having the spring-biased catch extended from the spring limb. The housing includes a depression formed therein for aligning with and for receiving the spring limb when the spring-biased catch is disengaged from the notch of the blade. The spring limb includes a slot formed therein for increasing a resilience of the spring limb.

The blade support device includes a spring arm extended therefrom, and a knob secured to the spring arm for moving the blade support device along the channel of the housing. The housing includes a plurality of cavities formed therein, the spring arm includes a latch extended therefrom and engageable with the cavities of the housing for securing the blade support device to the housing.

The disengaging means includes a button slidably received in the housing, the button includes at least one leg extended therefrom for engaging with the spring-biased catch and for disengaging the spring-biased catch from the blade to disengage the blade from the blade support device and to secure the blade to the blade support device. The button includes a pair of spring legs extended therefrom and includes a slit formed between the spring legs. A spring biasing device is further provided for biasing the spring legs from the spring-biased catch.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
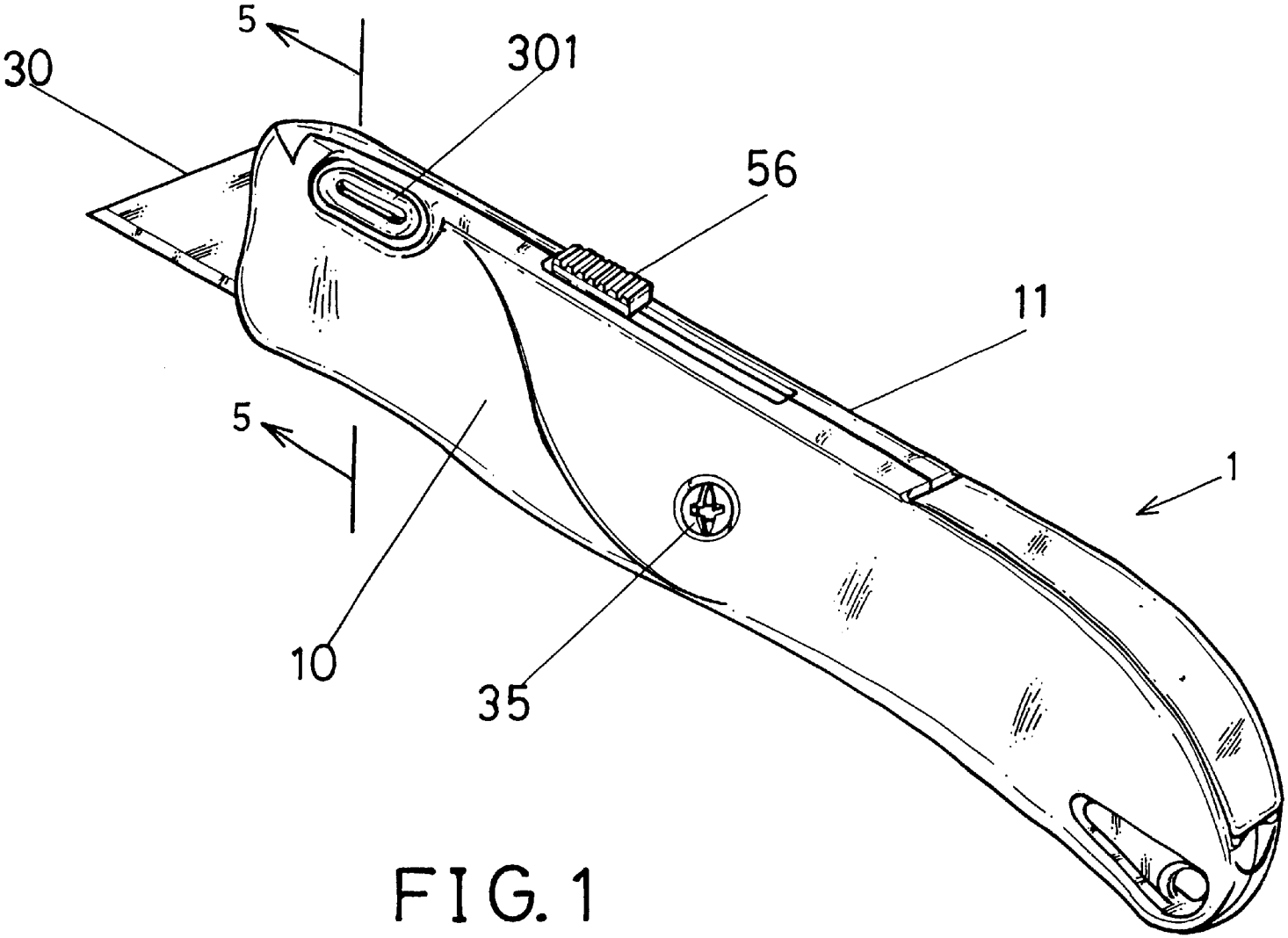
FIG. 1 is a perspective view of a knife in accordance with the present invention.
Figure 2:
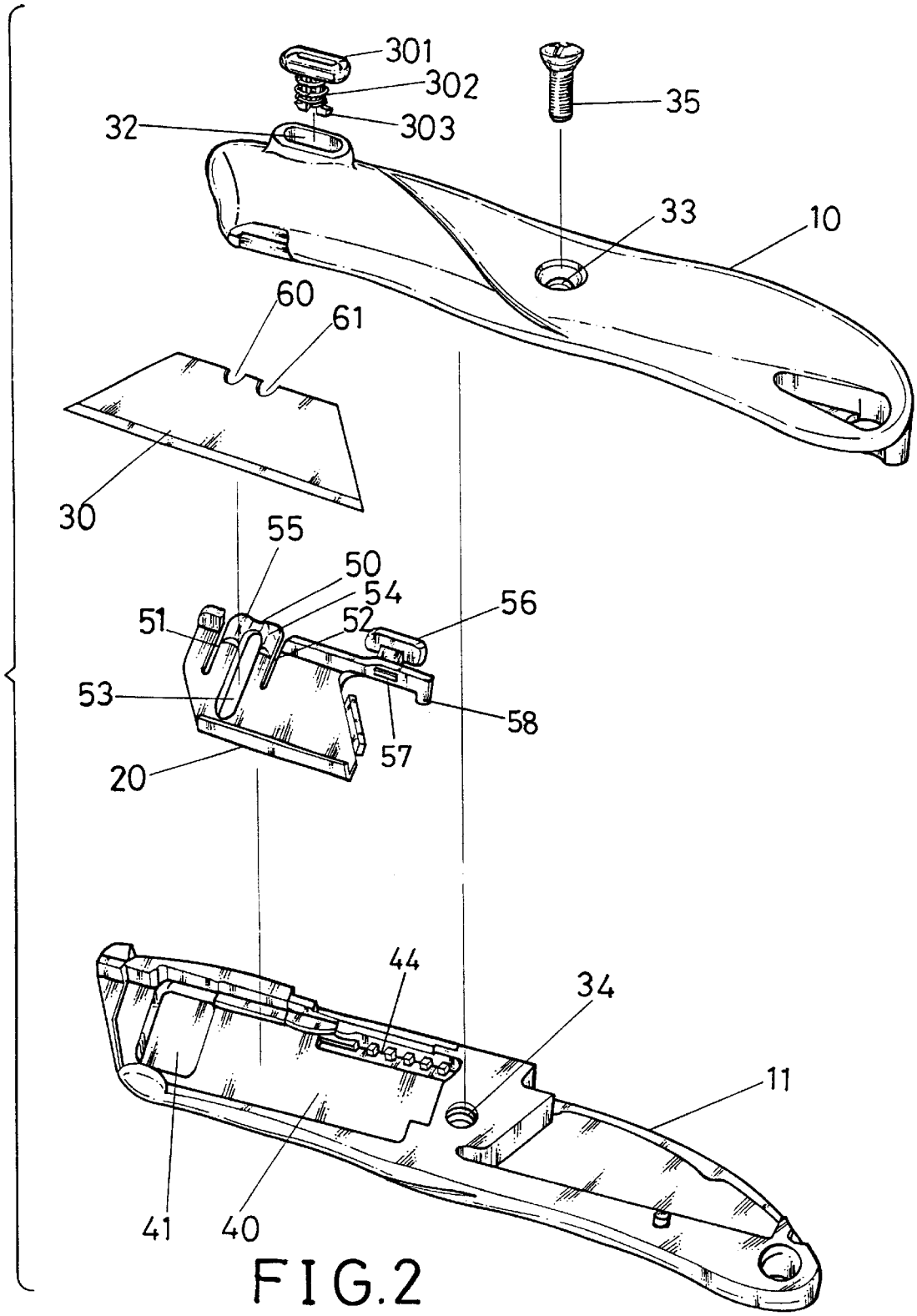
FIG. 2 is an exploded view of the knife.
Figure 3:
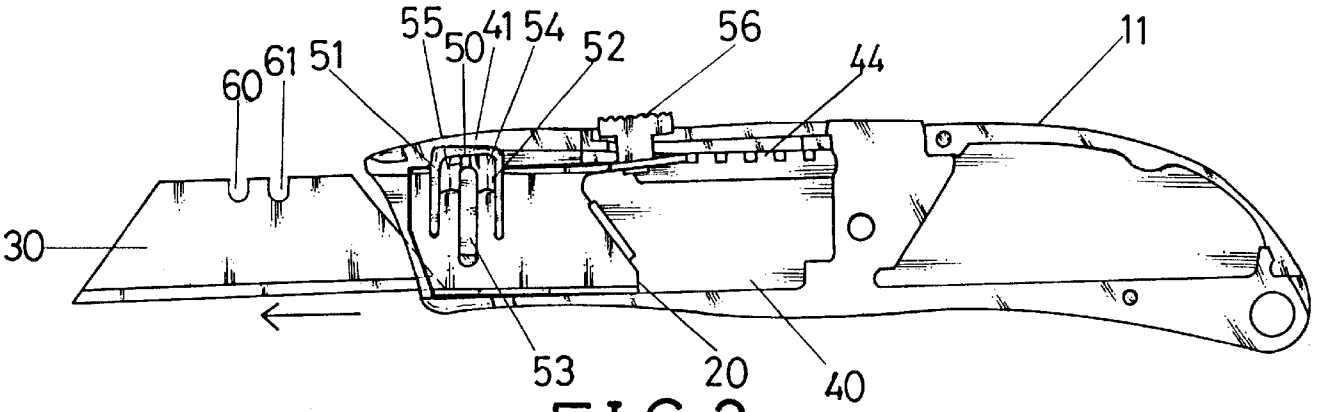
FIGS. 3 and 4 are plane views of the knife, in which one half of the housing has been removed for showing the inner structure of the knife and for illustrating the operation of the knife.

Referring to the drawings, and initially to FIGS. 1–3, a knife in accordance with the present invention comprises a handle or a housing 1 including two housing members 10. 11 secured together by one or more fasteners 35, for examples which may be engaged through the holes 33 of one of the housing members 10 and threaded with the screw holes 34 of the other housing member 11 in order to detachably secure the housing members 10, 11 together. The housing 1 includes a channel 40 formed therein, such as formed in one of the housing members 11. The housing member 11 includes a depression 41 formed therein and communicating with the channel 40 thereof, and includes a number of cavities 44 formed therein (FIG. 2).

Figure 7:
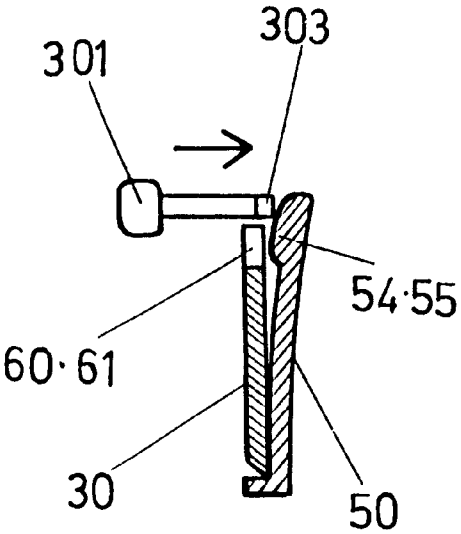
FIGS. 6 and 7 are schematic views illustrating the operation of the knife.

A blade support device 20 is slidably received in the channel 40 of the housing and includes a spring limb 50 formed therein and defined between a pair of parallel grooves 51, 52. The spring limb 50 includes one or more catches 54 55 extended therefrom for engaging with one or more notches 60, 61 of a blade 30 (FIGS. 4, 6) and for securing the blade 30 to the blade support device 20. The spring limb 50 preferably includes a slot 53 formed in the middle portion thereof for increasing the resilience of the spring limb 50 and for allowing the catches 54, 55 of the spring limb 50 to be easily engaged into or disengaged from the notches 60, 61 of the blade 30 (FIG. 7). A knob 56 is disposed on a spring arm 57 of the blade support device 20 and extended outward of the housing 1 (FIGS. 1, 3, 4) for allowing the knob 56 to move the blade support device 20 along the channel 40 of the housing 1. The spring arm 57 includes a latch 58 (FIG. 2) extended therefrom for engaging with either of the cavities 44 of the housing 1 (FIGS. 3, 4) and for securing the blade support device 20 to the housing 1.

Figure 5:
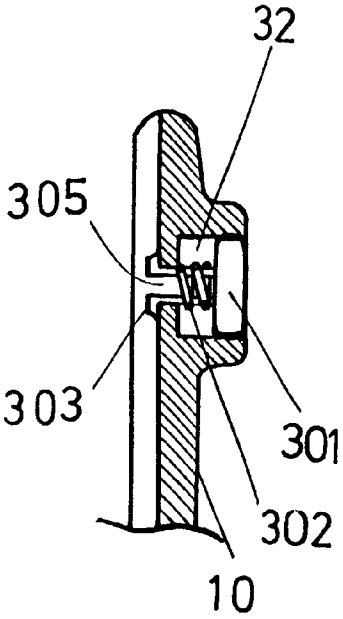
FIG. 5 is a partial cross sectional view taken along lines 5—5 of FIG. 1.

The housing member 10 of the housing 1 includes an opening 32 laterally formed therein and aligned with the depression 41 of the other housing member 11. A button 301 is slidably received in the opening 32 of the housing 1 and includes a pair of spring legs 303 formed therein for engaging with the housing 1 and for securing the button 301 to the housing 1. A slit 305 (FIG. 5) is formed in the button 301 for defining the spring legs 303 thereof. A spring 302 is engaged between the button 301 and the housing 1 for biasing the button 301 outward of the opening 32 of the housing 1 and for disengaging the spring legs 303 of the button 301 from the catches 54, 55 of the spring limb 50.

Figure 4:
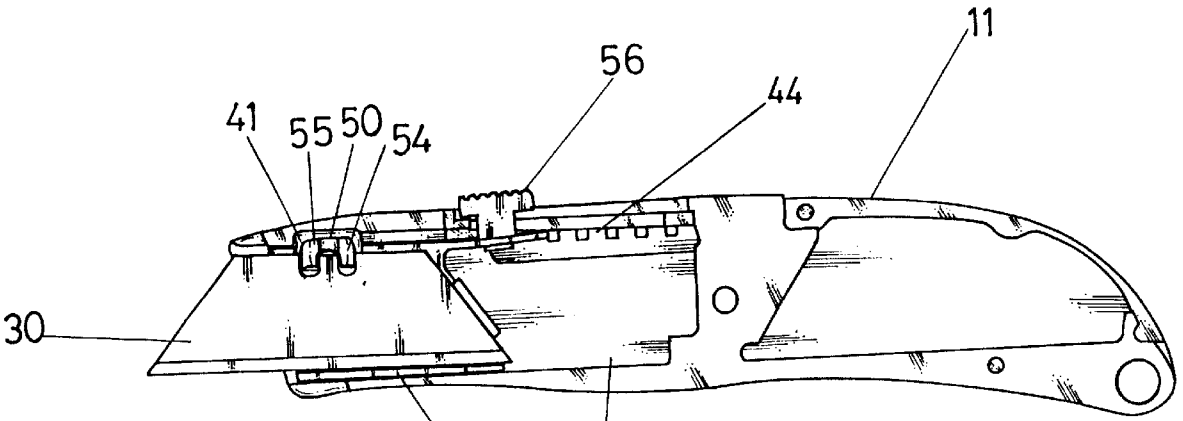
Figure 6:
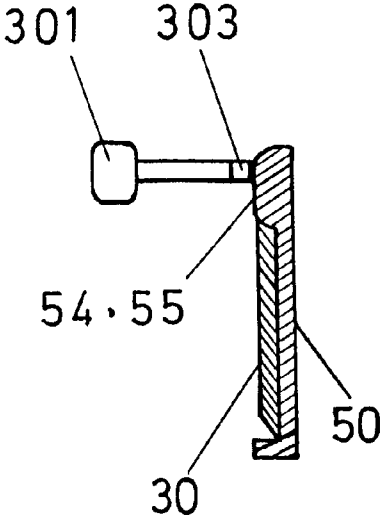

In operation, as shown in FIGS. 3, 4, and 7, when the spring limb 50 is aligned with the depression 41 of the housing 1 and when the button 301 is depressed inward of the opening 32 of the housing 1, the catches 54, 55 of the spring limb 50 may be disengaged from the notches 60, 61 of the blade 30, such that the blade 30 may be easily disengaged from the blade support device 20 without disengaging the blade support device 20 from the housing 1. When the button 301 is released, the catches 54. 55 of the spring limb 50 may engage with the notches 60. 61 of the blade 30 again in order to secure the blade 30 to the blade support device 20 again (FIG. 6).

Accordingly, the knife in accordance with the present invention includes a blade support device for allowing the blades to be easily and quickly changed without disassembling the housing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A knife comprising:

a housing including a channel formed therein, a blade support device slidably received in said channel of said housing, said blade support device including at least one spring-biased catch extended therefrom, a blade including at least one notch formed therein for receiving said at least one spring-biased catch and for securing said blade to said blade support device, and means for disengaging said at least one spring-biased catch from said blade to disengage said blade from said blade support device and to secure said blade to said blade support device, said disengaging means including a button slidably received in said housing, said button including at least one leg extended therefrom for engaging with said at least one spring-biased catch and for disengaging said at least one spring-biased catch from said blade to disengage said blade from said blade support device and to secure said blade to said blade support device.

2. The knife according to claim 1, wherein said blade support device includes a spring limb formed therein and having said at least one spring-biased catch extended from said spring limb.

3. The knife according to claim 2, wherein said spring limb includes a slot formed therein for increasing a resilience of said spring limb.

4. The knife according to claim 1, wherein said blade support device includes a spring arm extended therefrom, and a knob secured to said spring arm for moving said blade support device along said channel of said housing.

5. The knife according to claim 4, wherein said housing includes a plurality of cavities formed therein, said spring arm includes a latch extended therefrom and engageable with said cavities of said housing for securing said blade support device to said housing.

6. The knife according to claim 1, wherein said at least one leg includes a pair of spring legs extended from said button, and said button includes a slit formed between said spring legs.

7. The knife according to claim 6 further comprising means for biasing said spring legs from said at least one spring-biased catch.

8. A knife comprising:

a housing including a channel formed therein, a blade support device slidably received in said channel of said housing, said blade support device including a spring limb formed therein and having at least one spring-biased catch extended from said spring limb, a blade including at least one notch formed therein for receiving said at least one spring-biased catch and for securing said blade to said blade support device, and means for disengaging said at least one spring-biased catch from said blade to disengage said blade from said blade support device and to secure said blade to said blade support device, wherein said housing includes a depression formed therein for aligning with and for receiving said spring limb when said at least one spring-biased catch is disengaged from said at least one notch of said blade.

* * * * *